US007090019B2

(12) United States Patent
Barrow et al.

(10) Patent No.: US 7,090,019 B2
(45) Date of Patent: Aug. 15, 2006

(54) CASING CUTTER

(75) Inventors: Steve Barrow, Palm Beach Gardens, FL (US); Donald L. Thorne, New Iberia, LA (US); Dan Thomas Benson, Tomball, TX (US); Rich McCoy, Cypress, TX (US)

(73) Assignee: Oceaneering International, Inc., Houston, TX (US)

( * ) Notice: Subject to any disclaimer, the term of this patent is extended or adjusted under 35 U.S.C. 154(b) by 0 days.

(21) Appl. No.: 10/917,178

(22) Filed: Aug. 12, 2004

(65) Prior Publication Data

US 2005/0145389 A1 Jul. 7, 2005

Related U.S. Application Data

(60) Provisional application No. 60/494,518, filed on Aug. 12, 2003.

(51) Int. Cl.
*E21B 29/12* (2006.01)

(52) U.S. Cl. ..... 166/361; 166/55.7; 166/298

(58) Field of Classification Search ..... 166/368, 166/361, 55, 298, 55.7, 55.6, 55.8, 75.11, 166/348; 285/18, 363, 364, 368
See application file for complete search history.

(56) References Cited

U.S. PATENT DOCUMENTS 3,253,336 A * 5/1966 Brown ..... 30/98
3,330,339 A * 7/1967 Johnson ..... 166/352
3,766,979 A * 10/1973 Petrick ..... 166/55
4,191,255 A * 3/1980 Rives ..... 166/297
4,558,744 A * 12/1985 Gibb ..... 166/335
4,703,802 A * 11/1987 Bryan et al. ..... 166/298
5,310,286 A * 5/1994 Gilbert et al. ..... 405/169
5,318,115 A * 6/1994 Rouse ..... 166/55.7
5,458,439 A * 10/1995 Hall et al. ..... 405/158
6,029,745 A * 2/2000 Broussard et al. ..... 166/298
6,330,919 B1 * 12/2001 McGarian ..... 166/361
6,357,528 B1 * 3/2002 Davis et al. ..... 166/339
6,439,807 B1 * 8/2002 Wijsman ..... 405/170
6,827,145 B1 * 12/2004 Fotland et al. ..... 166/298

* cited by examiner

*Primary Examiner*—Thomas A Beach
(74) *Attorney, Agent, or Firm*—Duane Morris LLP

(57) ABSTRACT

A subsea well casing cutting tool for use as part of a well abandonment procedure, the casing cutting tool deployable from a vessel located at a water surface, where in certain embodiments the casing cutting tool comprises a casing gripper; a rotary cutter drive assembly; a rotary cutter; a rotating fluid union that allows high volume water to be fed to the rotating cutting assembly below the drive motor for purposes of extending the cutting blades; and a third party casing hanger removal tool wherein the casing cutting drive assembly forms an interface between the third party rotary casing cutter, an existing subsea casing, and a work class ROV. It is emphasized that this abstract is provided to comply with the rules requiring an abstract which will allow a searcher or other reader to quickly ascertain the subject matter of the technical disclosure. It is submitted with the understanding that it will not be used to interpret or limit the scope of meaning of the claims.

20 Claims, 14 Drawing Sheets

CASING CUTTER

RELATION TO PRIOR APPLICATIONS

This application claims priority through U.S. Provisional Application 60/494,518, filed Aug. 12, 2003.

FIELD OF INVENTION

The present invention relates generally to the field of tools suitable for use subsea to manipulate casings underwater, e.g. to cut them.

BACKGROUND OF THE INVENTION

Casings often need to be cut underwater, in situ. At times, portions of tubulars, e.g. casings or wellheads, need to be removed, such as when a well is abandoned. Often this is a difficult task.

Although standard, e.g. off-the-shelf type, tools are available, interfacing the various tools to platforms or tools needed to effect the cutting and removal is often difficult and often requires some degree of customization.

BRIEF DESCRIPTION OF THE DRAWINGS

The various drawings supplied herein are representative of one or more embodiments of the present inventions.

DETAILED DESCRIPTION OF EXEMPLARY EMBODIMENTS OF THE INVENTION

Figure 1:
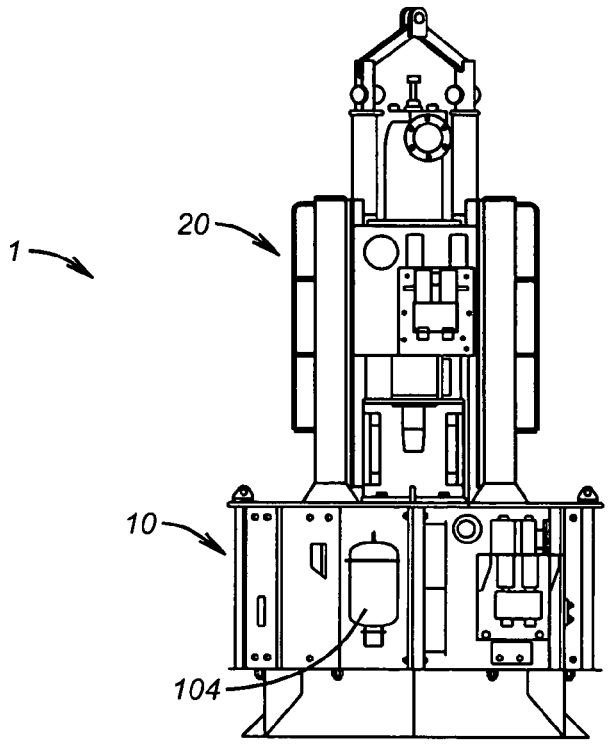
FIG. 1 is a view from a side of an exemplary embodiment showing a casing gripper coupled to a rotary cutter assembly.
Figure 2:
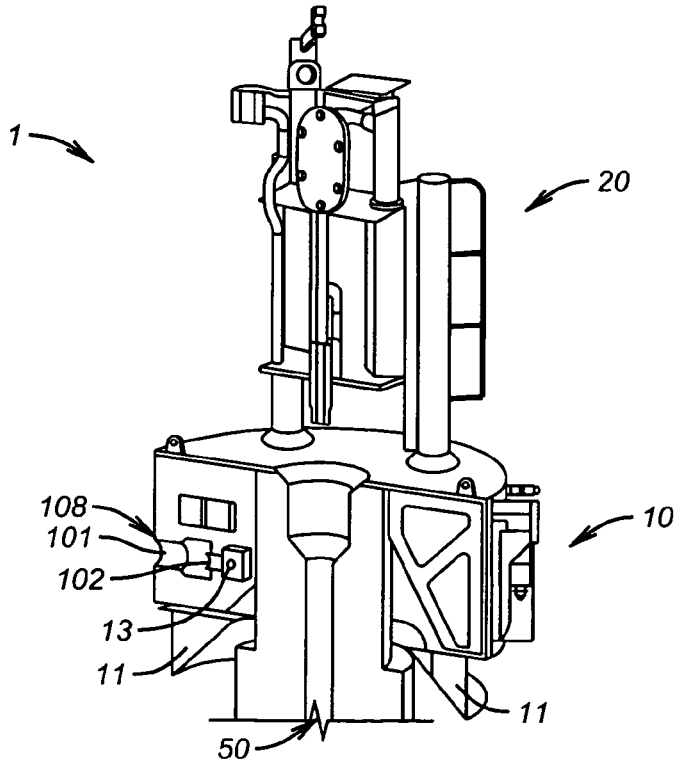
FIG. 2 is a cutaway view in partial perspective from a side of an exemplary embodiment showing a casing gripper coupled to a rotary cutter assembly.

Referring now to FIGS. 1 and 2, subsea well casing cutting tool 1 is adapted to be deployed from a vessel located at a water's surface (not shown the figures). In an embodiment, subsea well casing cutting tool 1 comprises casing gripper 10 and rotary cutter drive assembly 20.

Figure 3:
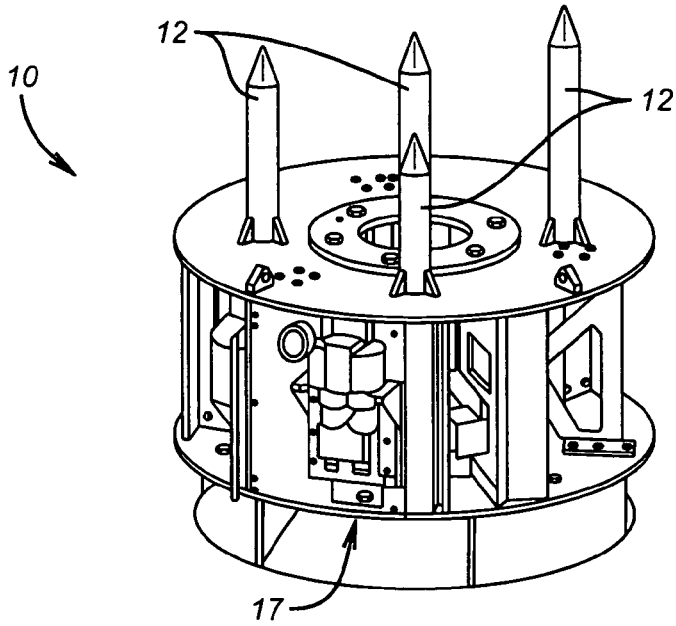
FIG. 3 is a view in partial perspective of a casing gripper.

Referring now additionally to FIGS. 2 and 3, casing gripper 10 comprises one or more casing guides 11 adapted to land casing gripper 10 on casing 50, one or more landing guides 12 (FIG. 3), and one or more clamps 13 adapted to secure casing gripper 10 about casing 50. As used herein, "casing" may be a casing, a tubular, a wellhead, or a similar component.

Casing guide 11 is adapted to help subsea well casing cutting tool 1 land on a top face of casing 50 and center rotary cutter drive assembly 20 in casing 50. In a preferred embodiment, casing guides 11 further comprise a plurality of hydraulic cylinders 108, each hydraulic cylinder 108 comprising piston 101; a plurality of jaw blocks 102, each jaw block 102 operatively connected to one of the plurality of hydraulic cylinders 108; and hydraulic accumulator 104 (FIG. 1) operatively connected to at least one of the plurality of hydraulic cylinders 108 where hydraulic accumulator 104 is useful in overcoming piston leakage and maintaining clamping force during cutting operations. Jaw blocks 102 are adapted to clamp around a diameter of casing 50.

Figure 4A:
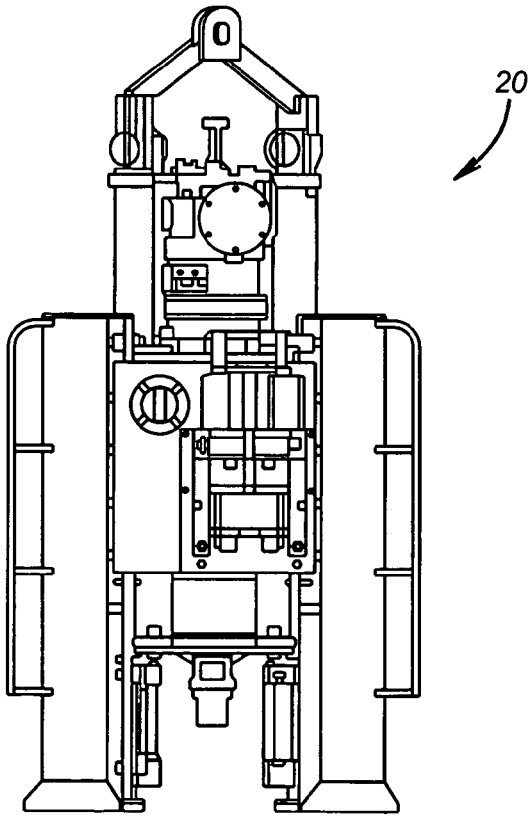
FIG. 4*a* is a view and FIG. 4*b* an exploded view in partial perspective of a casing cutter assembly.
Figure 4B:
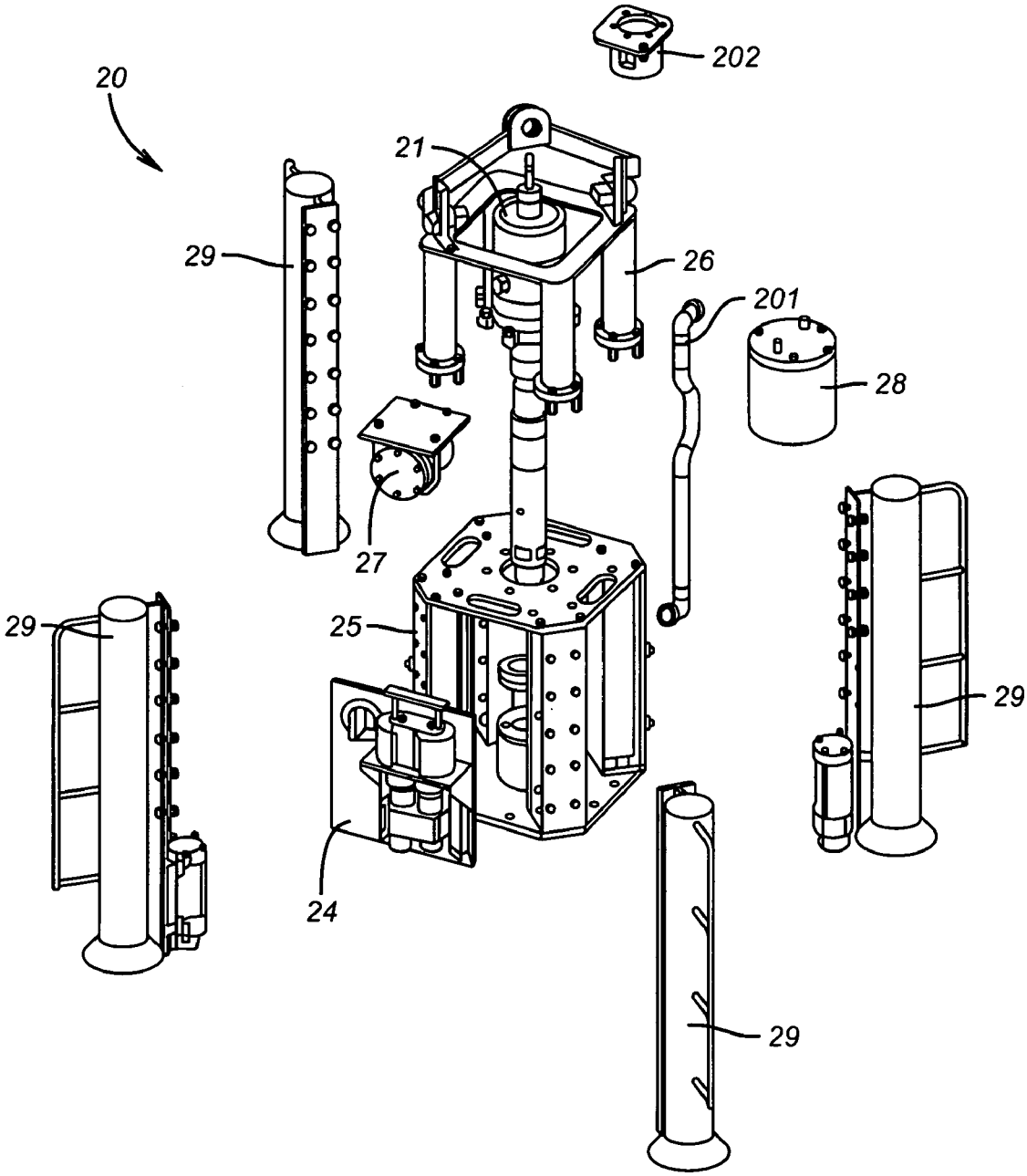
Figure 5:
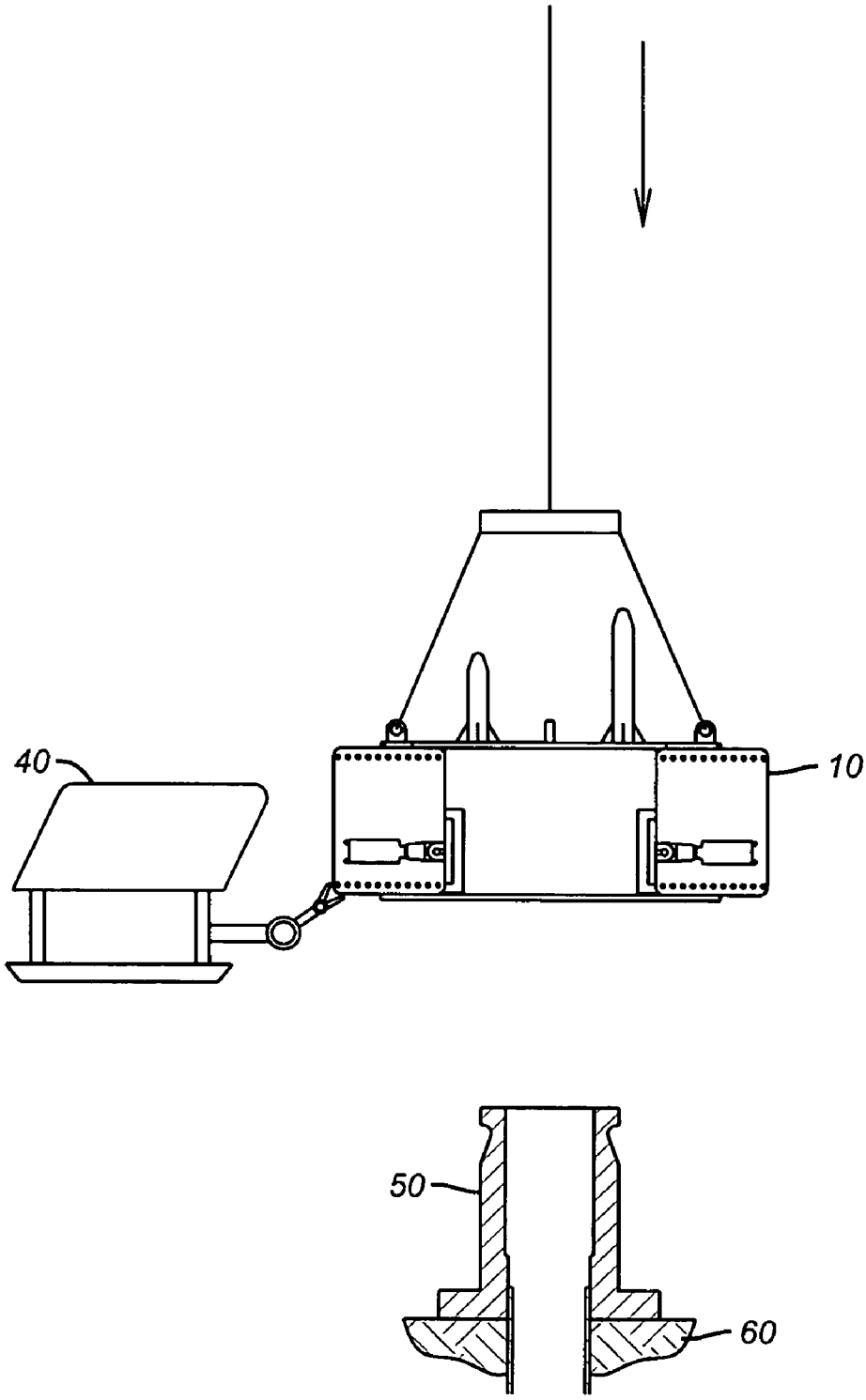
FIGS. 5–15 are diagrammatic views of exemplary methods of use of an exemplary embodiment of the present inventions.
Figure 8:
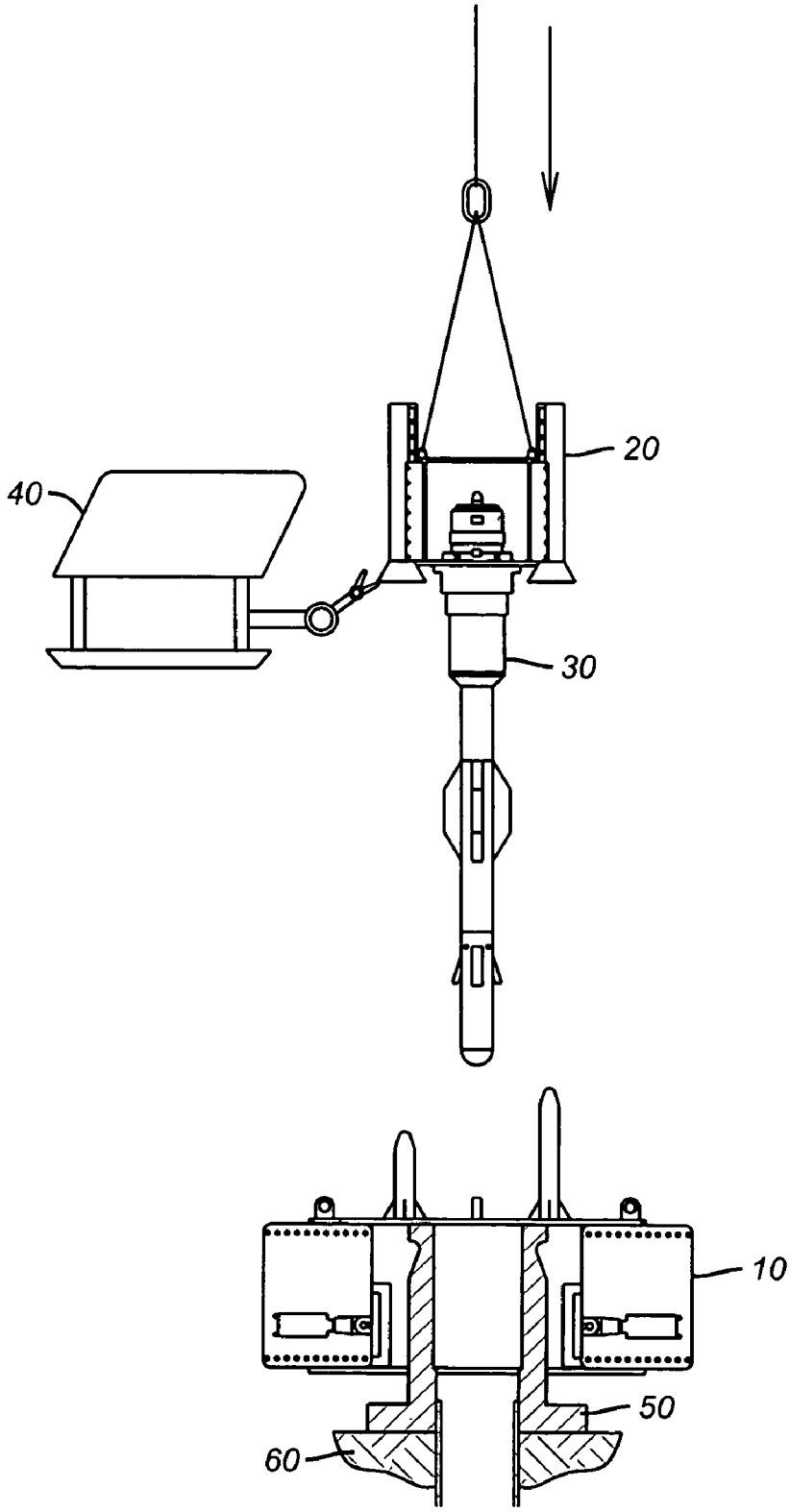

Referring now to FIGS. 4*a* and 4*b*, rotary cutter drive assembly 20 comprises drive motor 21 adapted to engage and provide power to rotary cutter 30 (FIG. 8), fluid slip ring 22 in communication with casing cutter tool 30, support bearing 23 adapted to support rotary cutter 30, one or more landing interfaces 29, each adapted to accept one landing guide 12, and ROV interface 24 adapted to mate with a remotely operated vehicle (ROV) 40 (FIG. 8). Water stab inlet 202 is adapted to accept fluids, e.g. water, to help energize components such as rotary cutter 30 such as via hose 201. Battery 28 may be operatively in communication with electronics present, e.g. associated with ROV interface 24 or electronic display 27.

Rotary cutter drive assembly 20 may further be adapted to accommodate rotary cutter 30 (FIG. 8) which may be in communication with rotary cutter drive assembly 20, e.g. disposed within cutting tool frame 25 and in communication with drive motor 21, where rotary cutter 30 comprises a cutting blade. Rotary cutter 30 may be a third party, e.g. a standard or off-the-shelf, rotary cutter as the term will be familiar to those of ordinary skill in the subsea tool arts. One or more valves may be used to control hydraulic flow to drive motor 21 which may comprise two drive sections.

Fluid slip ring 22 may further comprise a rotating fluid union adapted to allow high volume water to be fed to rotary cutter drive assembly 20 below drive motor 21. Fluid slip ring 22 may be adapted to extend the cutting blades, actuate the cutting blades, cool the cutting blades, or the like, or a combination thereof.

Drive motor 21 may be disposed within height adjustable motor assembly 26 comprising an interface to rotary cutter 30. Height adjustable motor assembly 26 is adapted to be adjusted to a predetermined height adjustment, e.g. a zero inch offset above a base, six inches above a base, twelve inches above a base, eighteen inches above a base, or the like, or a combination thereof. In FIG. 4*b*, the base may be frame 25. Hydraulic cylinders may be used to effect the adjustment to provide cutter assembly height adjustment ability, e.g. whereby a third party rotary cutter tool 30 can be raised within casing 50 in order allow cutting of a window in casing 50.

ROV interface 24 comprises a panel which may be interfaced to ROV 40 (FIG. 8). The panel may comprise one or more connectors for a hydraulic fluid, e.g. water or other oil or the like.

In certain embodiments, spear setting tool 70 (FIG. 8) may also be present. Casing hanger removal tool 71 and casing spear 72 may be aligned within spear setting tool 70 for use in removing a cut section of casing 50. Spear setting tool 70 may comprise an ROV operable paddle handle connected to a mechanical torque multiplier, whereby an ROV may use the paddle handle to rotate a multiplier wrist, thereby turning and setting the standard casing spear and an ROV panel to allow access by the ROV and the manipulator. Spear setting tool 70 may further comprise a plurality of clamp sections, the clamp sections forming a collar around a diameter of casing spear 72 when the clamp sections are in a closed condition and a plurality of bar handles which may be movably adjustable in a predetermined plane with respect to the standard casing spear, whereby ROV 40 may movably adjust the plurality of bar handles to turn and set casing spear 72.

In the operation of a preferred embodiment, referring now to FIGS. 5–15, subsea well casing cutting tool 1 may be deployed from a vessel located at a water's surface (not shown in the figures) for use in cutting a portion of casing 50, e.g. during a well abandonment procedure. Casing gripper 10 is deployed to engage casing 50 disposed about or under a seafloor 60. In certain embodiments, casing 50 is located and the cutting operations are accomplished at a depth that is at least 15 feet below the seafloor 60.

Figure 6:
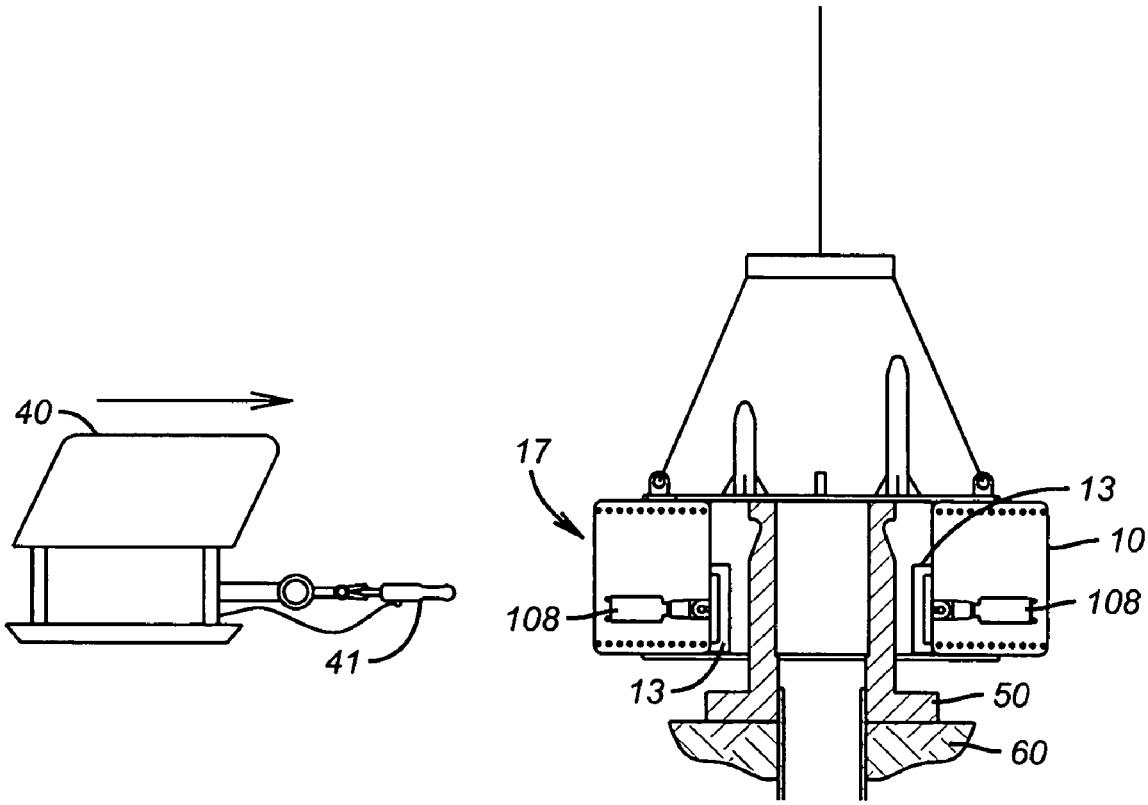

Referring to FIG. 6, once deployed, casing gripper 10 engages casing 50 to provide a substantially stable base for casing cutter assembly 20. As described above, casing gripper 10 may comprise a plurality of casing guides 11 that comprise a plurality of hydraulic cylinders, and at least one of casing guides 11 may be used to help land the deployed casing gripper 10 on a top face of casing 50.

After engaging casing gripper about casing 50, casing cutter assembly 20 is deployed and engages casing gripper 10. Casing cutter assembly 20 is then used to cut casing 50.

Casing gripper 10 may be deployed using remotely operated vehicle (ROV) 40.

In certain embodiments, casing gripper 10 comprises interface panel 17 (FIG. 3). ROV 40 may be used to insert hotstab 41 into a hotstab interface of interface panel 17. Once inserted, hotstab 41 may be used to pressurize casing gripper grip cylinders 108 of casing gripper 10 to a predetermined pressure, e.g. to clamp casing gripper 10 to casing 50. In certain embodiments, a subsea hydraulic power unit (not shown in the figures) may be used to supply fluids to casing gripper 10, e.g. for hydraulic power to casing gripper grip cylinders 108.

Figure 7:
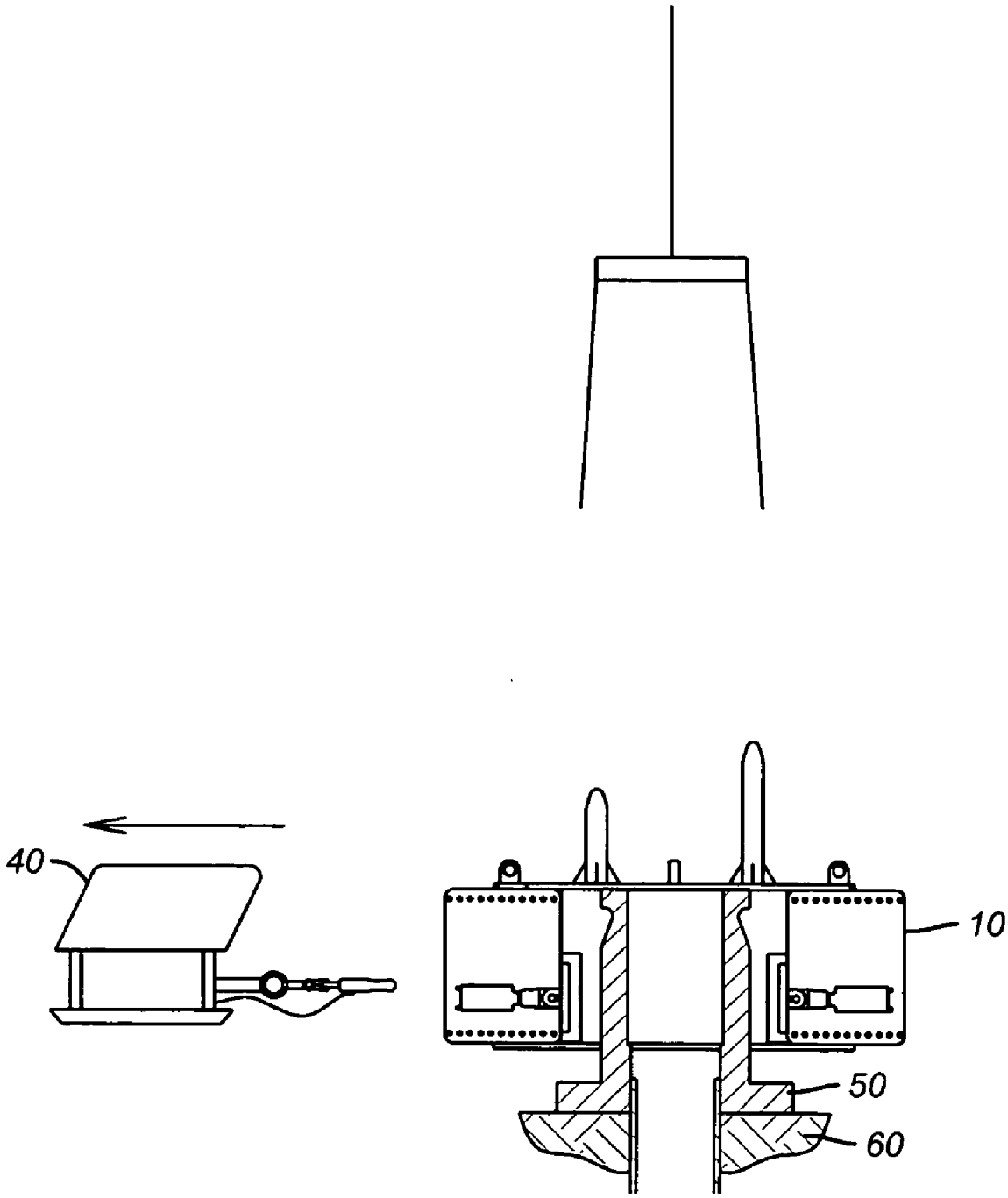

Hotstab 41 may be removed when the predetermined pressure is obtained (FIG. 7).

Figure 9:
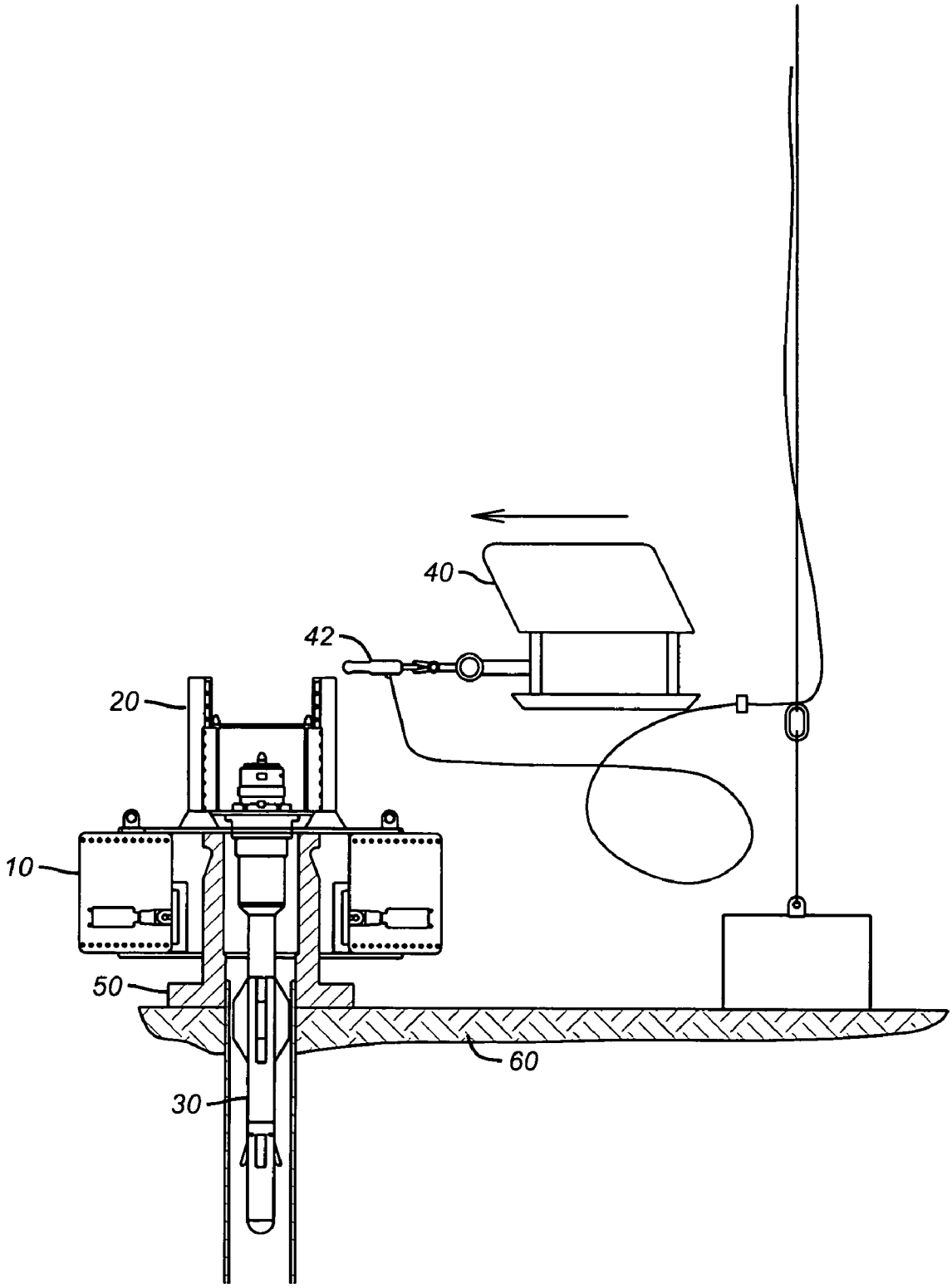

Referring to FIGS. 8 and 9, in typical usage, casing cutter assembly 20 is disposed at least partially within casing 50 and casing 50 is cut from the inside of the casing outward. Power may be supplied to components of casing cutter assembly 20, e.g. use of hydraulic fluids including water may be hotstabbed into casing cutter assembly 20 such as via hotstab 42. Hotstab 42 may be the same hotstab as hotstab 41.

Casing cutter assembly 20 may further comprise a height adjustable motor assembly 26 which may be used to adjust a motor 21 to a predetermined height. In an embodiment, one or more hydraulic cylinders may be used to effect the cutter assembly height adjustment and an offset may thereby be adjusted in a predetermined plane of rotary cutter tool 30 relative to an inner diameter of casing 50. In certain embodiments, one or more valves may be used to allow control of the positioning of height adjustment cylinders on height adjustable motor assembly 26. Once adjusted, i.e. when the offset in the predetermined plane is adjusted to a desired offset, a window may be cut in casing 50.

Once casing 50 is cut, casing cutter assembly 20 may be withdrawn.

Figure 10:
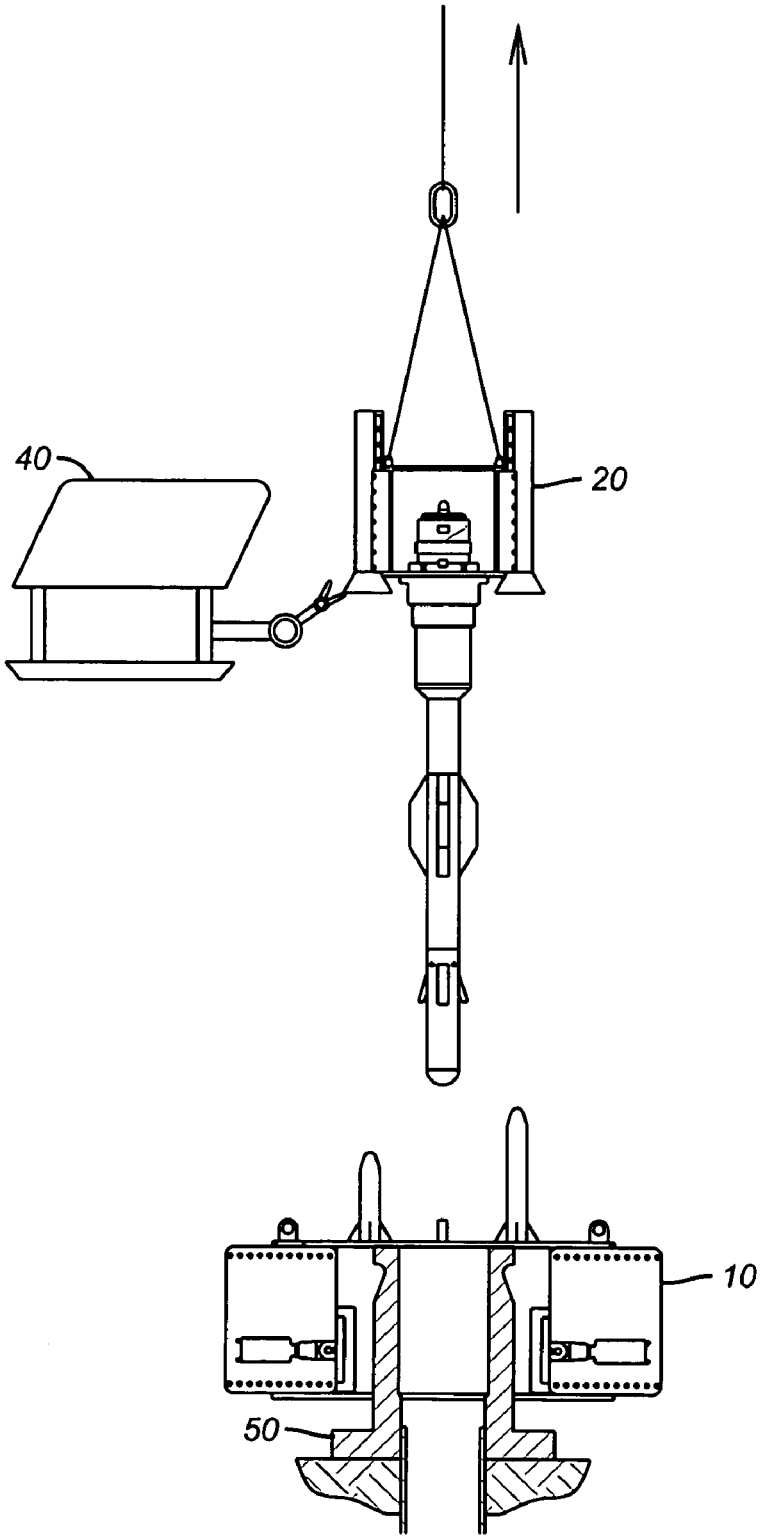

Referring now to FIG. 10, spear setting tool 70 may be positioned proximate, e.g. into, a portion of casing 50 that has been cut and then used to help retrieve the cut portion of casing 50. For embodiments in which spear setting tool 70 further comprises an ROV operable paddle handle connected to a mechanical torque multiplier, ROV 40 may be connected to ROV panel 72 and then access the paddle handle to rotate multiplier wrist 73, thereby turning and setting the standard casing spear 71.

Figure 11:
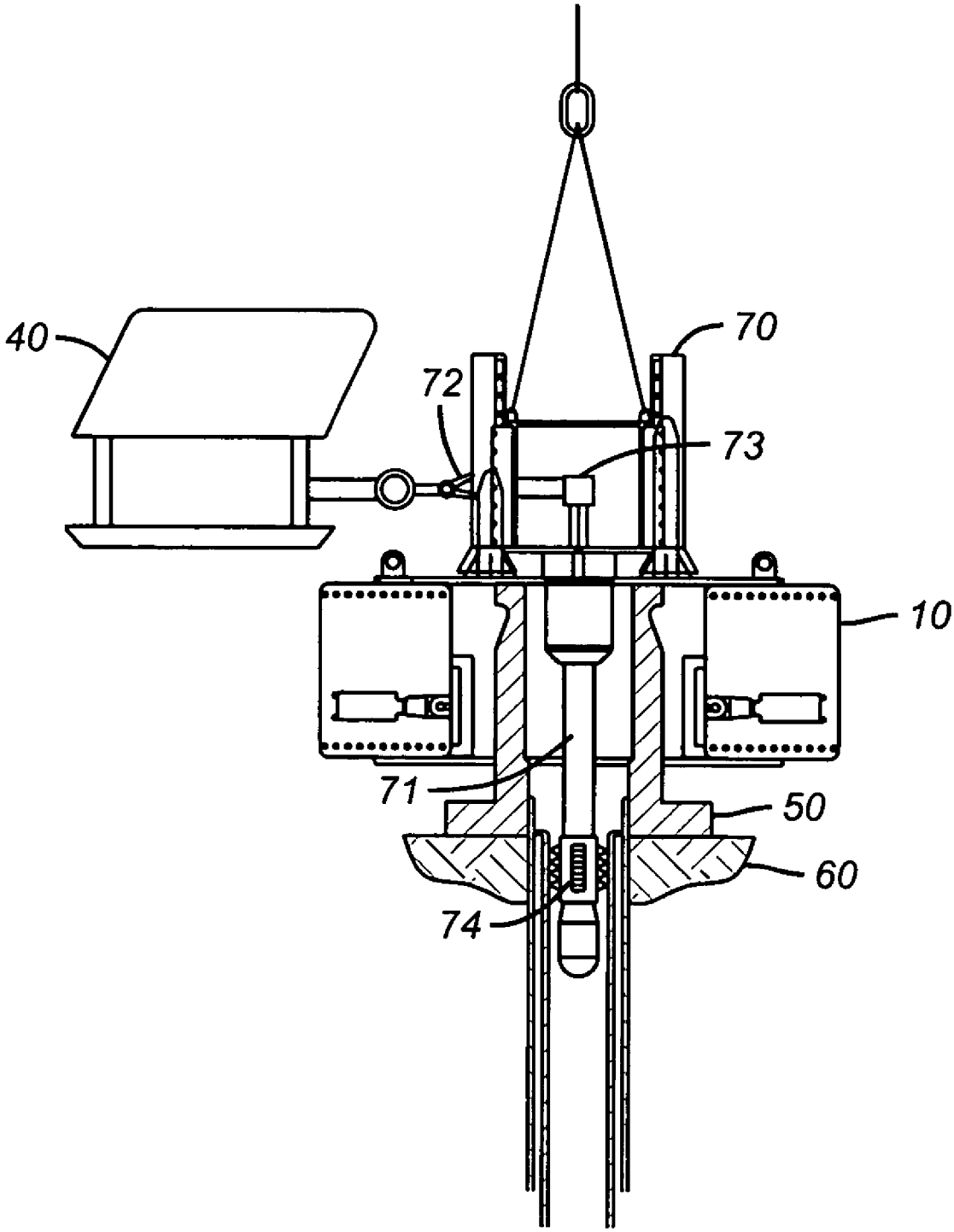

Referring to FIG. 11, if spear setting tool 70 further comprises one or more clamp sections 74, clamp sections 74 may be selectively opened or closed and a collar formed around a diameter of casing spear 71 within casing 50, e.g. when clamp sections 74 are in a closed condition.

Figure 12:
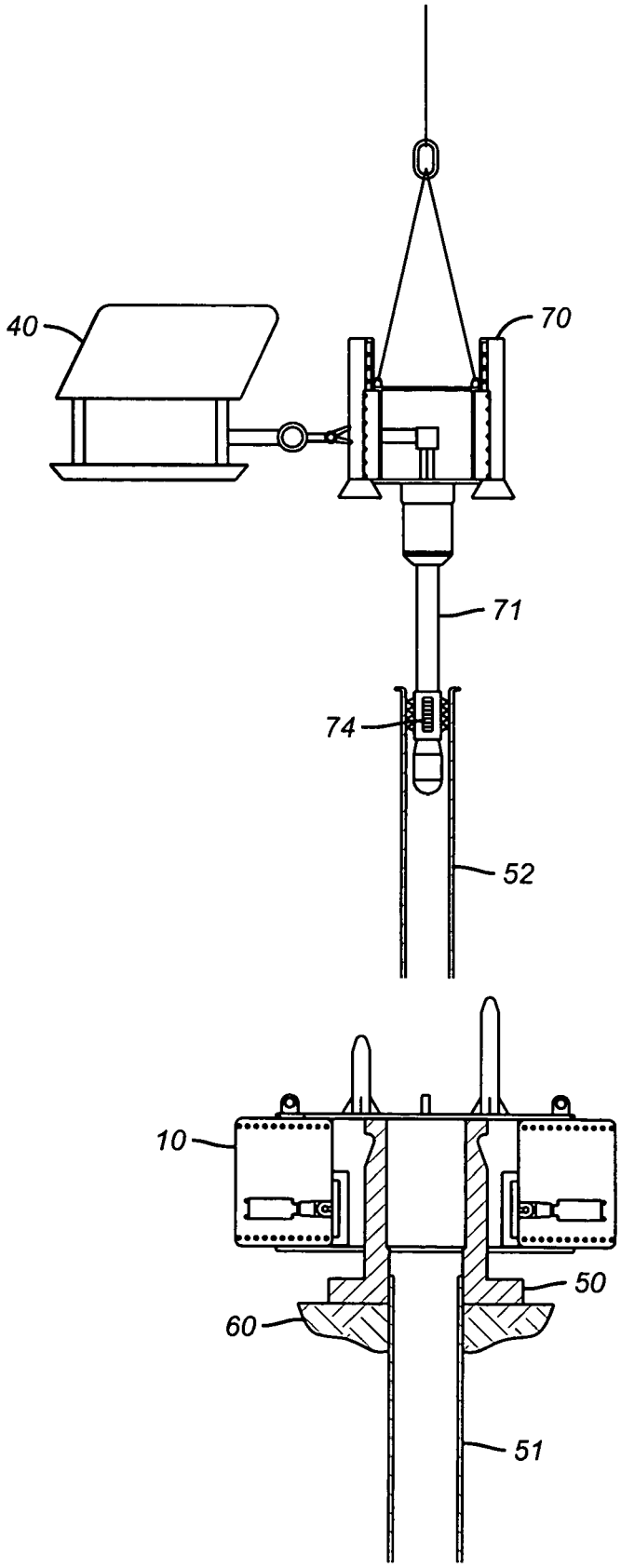

Referring now to FIG. 12, once clamped, cut section 52 may be removed by removing spear setting tool 71, leaving casing 50 and remaining portion 51 in place.

Figure 13:
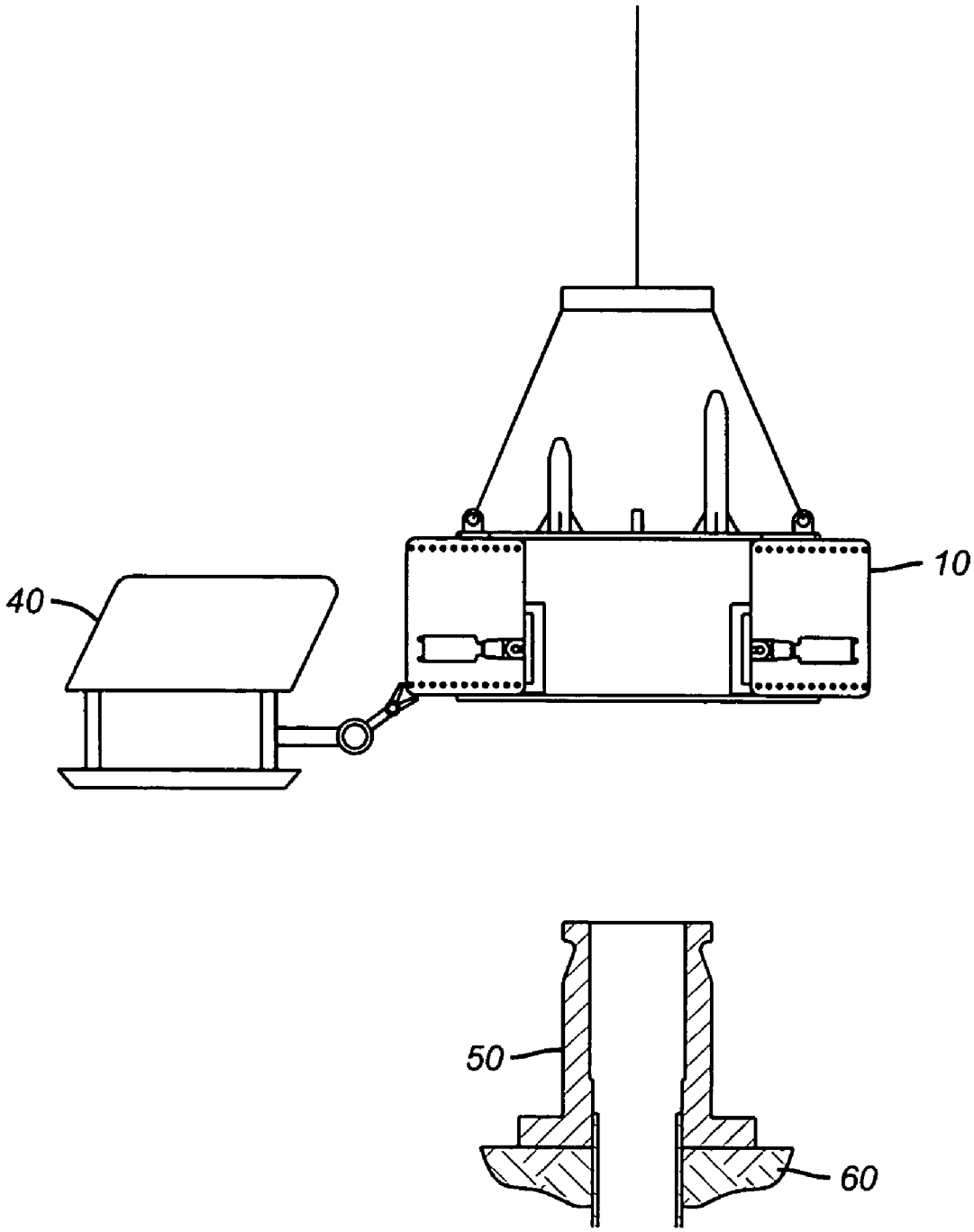

Referring to FIG. 13, when cutting operations are completed, casing gripper 10 may be removed, e.g. using ROV 40.

Figure 14:
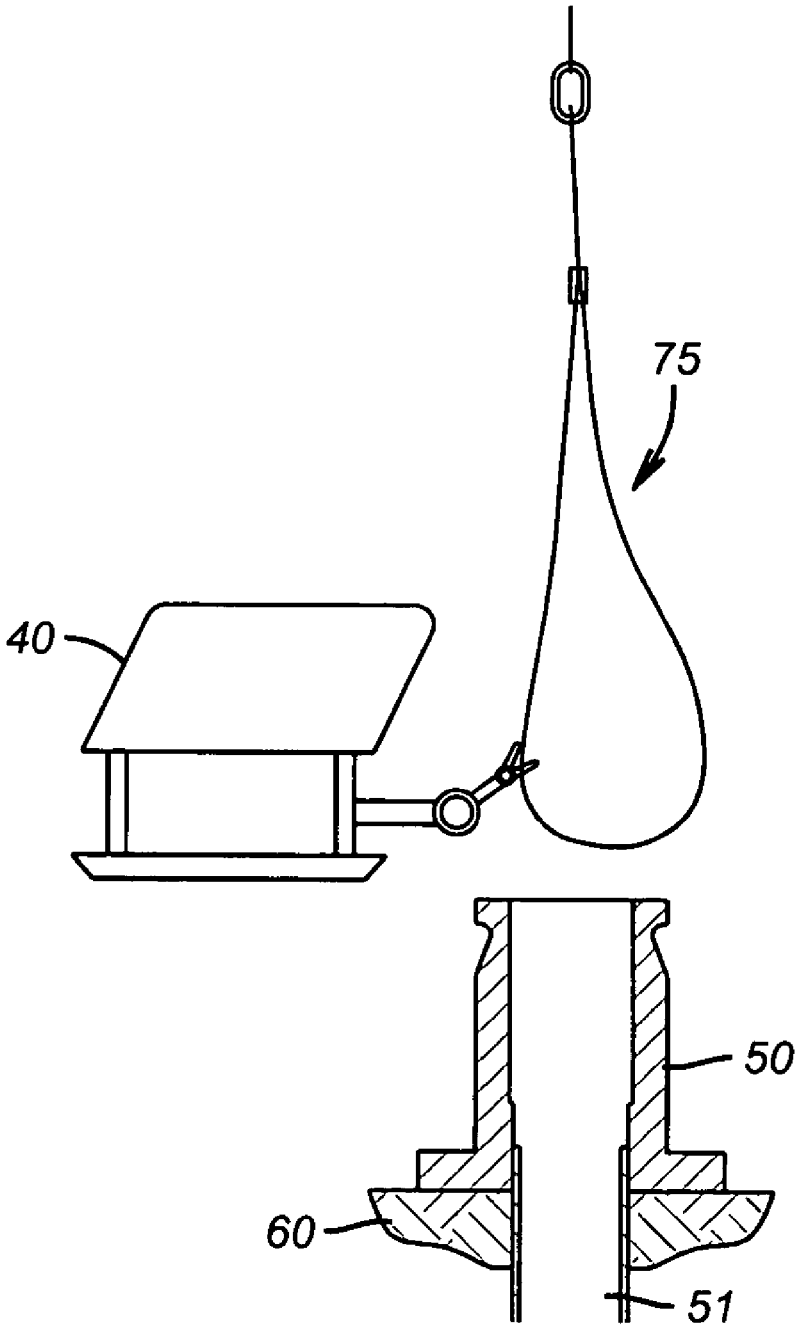
Figure 15:
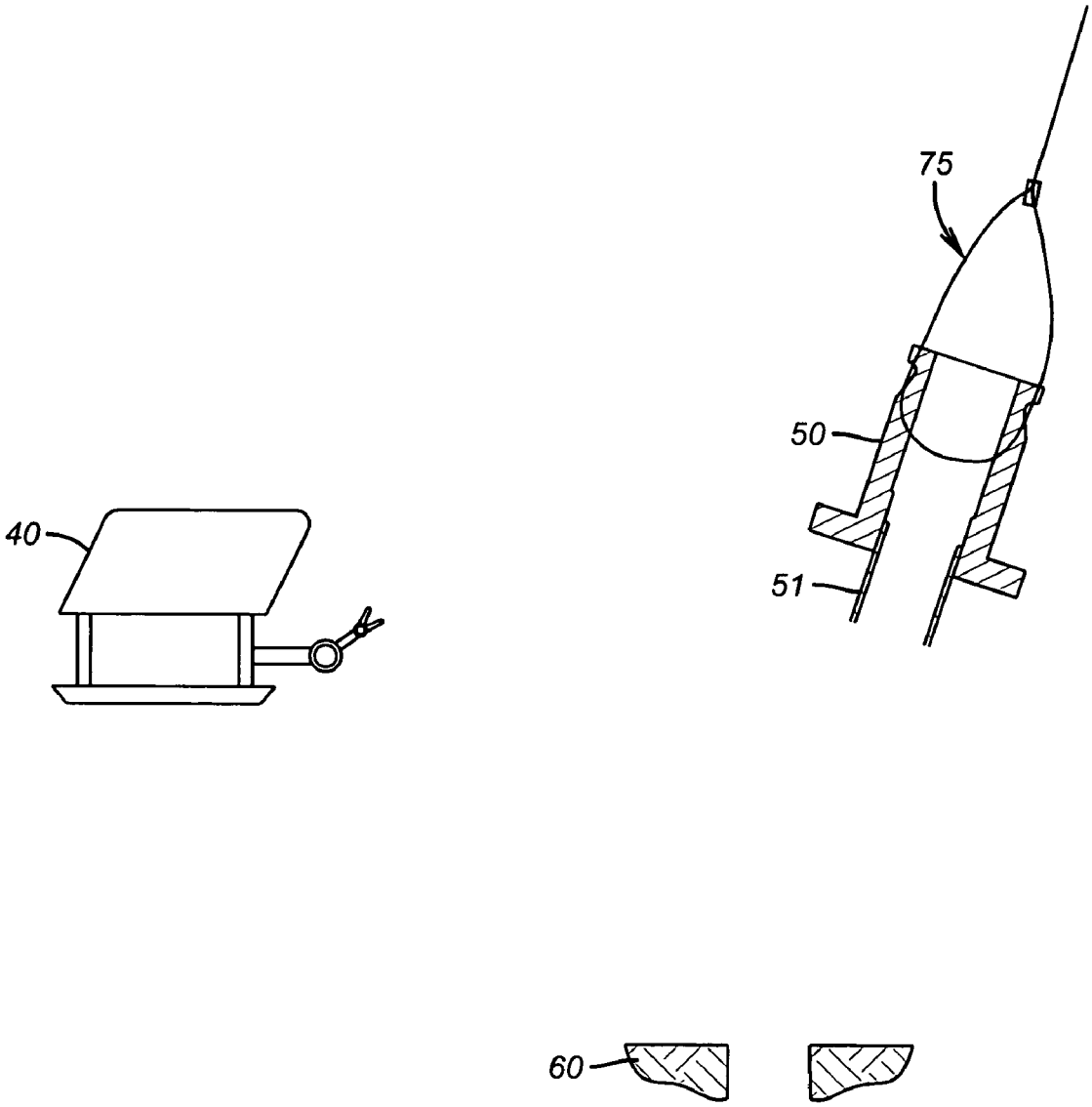

Referring to FIGS. 14–15, casing 50, i.e. a portion of casing 50 remaining at seafloor 60 but not longer connected to remaining portion 51, may also be retrieved, e.g. using cable 75.

It will be understood that various changes in the details, materials, and arrangements of the parts which have been described and illustrated above in order to explain the nature of this invention may be made by those skilled in the art without departing from the principle and scope of the invention as recited in the following claims.

What is claimed is:

1. A subsea well casing cutting tool, adapted to be deployed from a vessel located at a water surface, comprising:

a. a casing gripper, comprising
   1. a casing guide adapted to land the casing gripper on a casing;
   2. a landing guide; and
   3. a clamp adapted to secure the casing gripper about the casing; and b. a rotary cutter drive assembly, comprising:
   1. a drive motor adapted to engage and provide power to a rotary casing cutter;
   2. a landing interface adapted to accept the landing guide;
   3. a frame adapted to receive the rotary casing cutter;
   4. an ROV interface adapted to operatively mate with a remotely operated vehicle (ROV); and c. a rotary cutter disposed proximate the rotary cutter drive assembly.

2. The subsea well casing cutting tool of claim 1, wherein the rotary cutter drive assembly is disposed at least partially within casing and adapted to allow the casing to be cut from the inside of the casing outward.

3. The subsea well casing cutting tool of claim 1, further comprising:

a. a fluid slip ring in communication with the casing cutter tool;

b. a support bearing adapted to support the casing cutter tool;

c. wherein the fluid slip ring further comprises a rotating fluid union adapted to allow high volume water to be fed to the rotating cutting assembly below the drive motor and adapted to at least one of (i) extend the cutting blades, (ii) actuate the cutting blades, or (iii) cool the cutting blades.

4. The subsea well casing cutting tool of claim 1, wherein the casing guide comprises a plurality of casing guides adapted to help the subsea well casing cutting tool land on a top face of the casing and center the drive assembly in the casing.

5. The subsea well casing cutting tool of claim 4, wherein the casing guides further comprise:

a. a plurality of hydraulic cylinders, each hydraulic cylinder comprising a piston;

b. a plurality of jaw blocks, each jaw block operatively connected to one of the plurality of hydraulic cylinders; and c. a hydraulic accumulator operatively connected to at least one of the plurality of hydraulic cylinders, the hydraulic accumulator useful in overcoming piston leakage and maintaining clamping force during cutting operations; wherein the jaw blocks clamp around a diameter of the casing.

6. The subsea well casing cutting tool of claim 1, wherein the casing cutter further comprises a height adjustable motor assembly comprising an interface to a cutting tool.

7. The subsea well casing cutting tool of claim 6, wherein height adjustable motor assembly is adapted to be adjusted to a predetermined height adjustment with respect to a predetermined plane.

8. The subsea well casing cutting tool of claim 7, wherein the predetermined height adjustment is at least one of (a) zero inch offset above a base, (b) six inches above a base, (c) twelve inches above a base, or (d) eighteen inches above a base.

9. The subsea well casing cutting tool of claim 1, wherein the ROV interface comprises an ROV operable panel further comprising a connector adapted to receive hydraulic fluid.

10. A method of using a subsea well casing cutting tool, comprising:

a. deploying a casing gripper from a vessel located at a water's surface to engage a casing disposed about a seafloor;

b. engaging the casing gripper about the casing to provide a substantially stable base for a casing cutter assembly;

c. deploying a casing cutter assembly from a vessel located at a water's surface;

d. mating the casing cutter assembly on the casing gripper; and e. using a cutter disposed within the casing to cut the casing.

11. The method of claim 10, wherein the casing cutter assembly is mated to the casing gripper using casing gripper landing guides adapted to accept casing cutter assembly landing interfaces.

12. The method of claim 10, wherein the casing gripper is deployed using a remotely operated vehicle (ROV).

13. The method of claim 12, wherein the casing gripper comprises an interface panel, the method further comprising:

a. inserting a hotstab into a hotstab interface of the interface panel; and b. pressuring casing gripper grip cylinders of the casing gripper to a predetermined pressure; and c. removing the hotstab when the predetermined pressure is obtained.

14. The method of claim 10, wherein:

a. the casing cutter assembly is disposed at least partially within the casing; and b. the casing is cut from the inside of the casing outward.

15. The method of claim 14, further comprising using the ROV to connect a hydraulic supply to a hydraulic interface port on the casing cutter.

16. The method of claim 10, wherein the casing and the cutting are accomplished at a depth that is at least 15 feet below the seafloor.

17. The method of claim 10, wherein the cutting is used during a well abandonment procedure.

18. The method of claim 10, further comprising:

a. engaging a spear setting tool proximate a portion of the casing that has been cut; and b. retrieving the cut portion of the casing using the casing removal tool.

19. The method of claim 18, further comprising allowing a standard casing spear to be aligned within a casing collar of the spear setting tool.

20. The method of claim 10, further comprising:

a. using a hydraulic cylinder to provide a cutter assembly height adjustment;

b. adjusting an offset in a predetermined plane of a rotary cutter tool disposed within an inside diameter of the casing; and c. cutting a window in the casing when the offset in the predetermined plane is adjusted to a desired offset.

* * * * *